US005862847A

United States Patent [19]

Jenkins

[11] Patent Number: 5,862,847

[45] Date of Patent: Jan. 26, 1999

[54] CASKET AND METHOD OF MANUFACTURE

[75] Inventor: Kenneth T. Jenkins, Old Forge, Pa.

[73] Assignee: Chesapeake Packaging Company, Scranton, Pa.

[21] Appl. No.: 939,665

[22] Filed: Sep. 29, 1997

Related U.S. Application Data

[62] Division of Ser. No. 666,200, Jun. 20, 1996.

[51] Int. Cl.[6] ..... B27D 1/00; A61G 17/00

[52] U.S. Cl. ..... 144/346; 144/329; 144/359; 27/4; 220/560.15; 229/122.34

[58] Field of Search ..... 27/1, 4, 3, 10, 27/19; 220/560.15; 229/122.34

[56] References Cited

U.S. PATENT DOCUMENTS

| | | | |
|---|---|---|---|
| 2,075,679 | 3/1937 | Weber | 220/443 |
| 3,729,786 | 5/1973 | Walding | 27/4 X |
| 4,209,880 | 7/1980 | Lidholm | 27/2 |
| 4,253,206 | 3/1981 | Cherry | 27/4 X |
| 4,305,186 | 12/1981 | Cherry | 27/4 |
| 4,655,366 | 4/1987 | Sykes | 229/939 X |
| 4,730,370 | 3/1988 | Elder | 27/4 |
| 4,800,631 | 1/1989 | Pellman | 27/7 |
| 5,035,032 | 7/1991 | Nutting | 27/4 |
| 5,353,484 | 10/1994 | Woedl, et al. | 27/4 |
| 5,454,141 | 10/1995 | Ozbun, et al. | 27/4 |
| 5,770,291 | 6/1998 | Tambussi | 27/4 X |
| 5,771,549 | 6/1998 | Saaf | 27/4 |

OTHER PUBLICATIONS

Statutory Invention Registration No. 1348—Sep. 6, 1994—Linville et al.

*Primary Examiner*—W. Donald Bray
*Attorney, Agent, or Firm*—Joseph G. Seeber

[57] ABSTRACT

A casket comprises an outer structure, a tray and an insert. The tray is formed of corrugated fiberboard having a corrugation extending in a first direction, while the insert is formed of corrugated fiberboard having a corrugation extending in a second direction perpendicular to the first direction. The casket has either a full lid or a split lid, and the lid is either flat or optionally curved. The structural integrity of the casket is improved by provision of side wraps, end wraps and pads inserted between each end wall and its respective end wrap. Methods of constructing the various alternative casket lids are also disclosed. Components are made of wood, corrugated fiberboard and foam.

11 Claims, 20 Drawing Sheets

CASKET AND METHOD OF MANUFACTURE

This is a divisional of co-pending application Ser. No. 08/666,200, filed Jun. 20, 1996.

TECHNICAL FIELD

The present invention generally relates to a casket and method of manufacture, and more particularly to a casket made of corrugated fiberboard, foam, wood, adhesive, metal staples, screws and/or rivets.

BACKGROUND ART

Typically, caskets are manufactured in order to provide an aesthetic receptacle for the purpose of display of the deceased and use during funeral ceremonies. However, under certain circumstances, especially when cremation is desired, economy and a desire to facilitate cremation dictates that the casket be constructed of some material, such as corrugated fiberboard, which is both economical and easily burned. However, at the same time, the casket must be strong and substantial in construction.

Needless to say, in the past, the desire for an aesthetic casket has convicted with the desire to provide an economical and easily cremated receptacle, as well as the desire to provide a strong casket. Thus, there has been a need in the prior art for the development of a casket and method for manufacture, wherein the casket can be constructed in such a manner as to satisfy all of the latter competing interests.

The following are considered to be generally relevant to the art pertaining to the present invention: Statutory Invention Registration H1348-Linville et al; U.S. Pat. No. 3,729,786-Walding; U.S. Pat. No. 4,253,206-Cherry; U.S. Pat. No. 4,305,186-Cherry; and U.S. Pat. No. 4,730,370-Elder.

Disclosure of Invention

The present invention generally relates to a casket and method for manufacture, and more particularly, to a casket made of corrugated fiberboard but having aesthetic characteristics and strength so as to facilitate its use in normal funeral ceremonies and related activities, while at the same time being economical and of such a construction as to facilitate cremation, if that is desired.

Preferably, the casket of the present invention is constructed of corrugated fiberboard, foam, wood, adhesive and metal staples and screws. Several different grades of corrugated fiberboard are specially cut and scored, and the corrugation direction is selected in such a manner as to maximize strength of the resulting casket.

Preferably, the design and method of manufacture is such as to constitute an efficient use of labor highlighted by ease of assembly. The casket of the present invention comprises a squared body having optional corner moldings made of the aforementioned materials. The casket of the present invention has, in one embodiment, a split lid arrangement comprising a raised, flat lid and an optional curved lid laminated on top of it. In another embodiment, the casket has a single lid arrangement comprising a raised, flat, full lid and an optional curved lid laminated on top of it.

Therefore, it is a primary object of the present invention to provide a casket and method of manufacture.

It is an additional object of the present invention to provide a casket and method of manufacture, wherein the resulting casket is both economical and aesthetic.

It is an additional object of the present invention to provide a casket and method of manufacture, wherein the casket is sufficiently aesthetic and strong for the purpose of funeral ceremonies and the like, while being sufficiently economical and of such a construction as to facilitate its use in cremation.

It is an additional object of the present to provide a casket and method of manufacture, wherein the casket has a split-lid arrangement.

It is an additional object of the present invention to provide a casket and method of manufacture, wherein the casket has a single or full-lid arrangement.

It is an additional object of the present invention to provide a casket and method of manufacture, wherein the casket has an optional curved lid laminated on top.

The above and other objects, and the nature of the invention, will be more clear from the following detailed description, the accompanying drawings, and the appended claims.

BEST MODE FOR CARRYING OUT THE INVENTION

The invention will now be described in more detail with reference to the various figures of the drawings.

Figure 1:
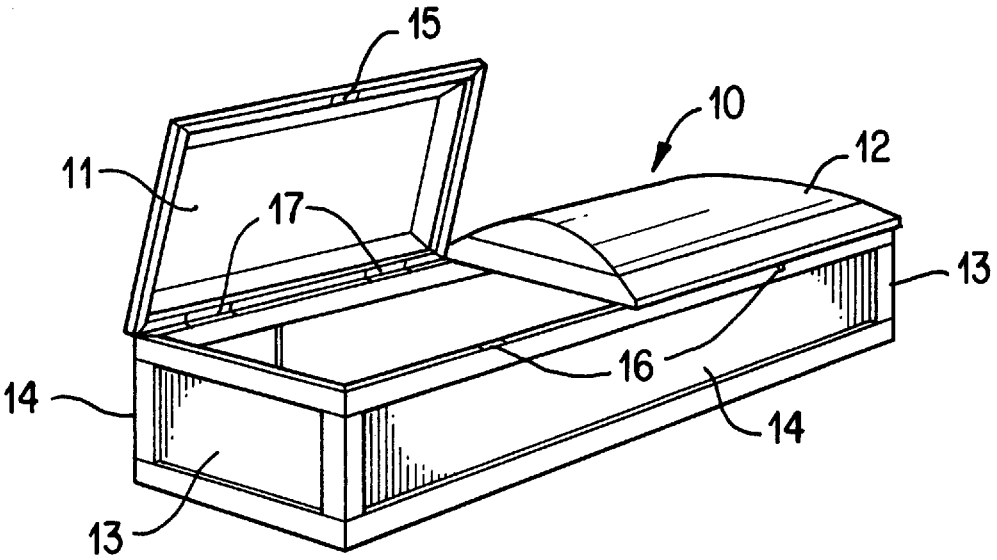
FIG. 1 is a perspective view of a split-lid casket in the open condition.
Figure 3:
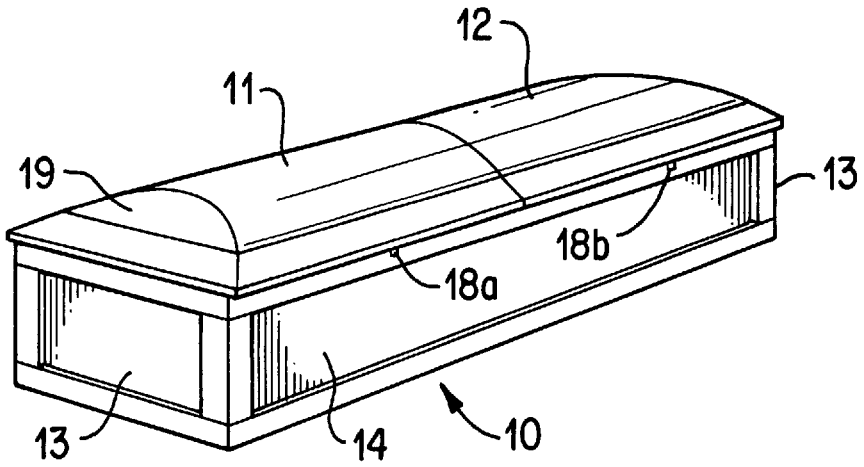
FIG. 3 is a perspective view of the casket of FIG. 1 in the closed condition.

FIGS. 1 and 3 are perspective views of a split-lid casket in the open condition and closed condition, respectively. As seen therein, the split-lid casket 10 comprises split lids 1I1 and 12, end walls 13, and side walls 14.

Thus, FIG. 1 illustrates the assembled version of the casket with a raised, curved split lids 11 and 12, with the lid 11 being in the open position. The casket 10 has a preprinted, corrugated fiberboard exterior supported by wood and foam pieces (not shown in FIGS. 1 and 3). End walls 13 form a preprinted end of the split lid casket 10, and the unadorned interior of the casket 10 can be seen through the space vacated by the open lid II. Metal latch hardware 15 and 16 and corrugated fiberboard hinges 17 are provided on the casket 10. Referring to FIG. 3, thumb latches 18*a* and 18*b* and the end 19 of the curved lid 11 are illustrated.

Figure 2:
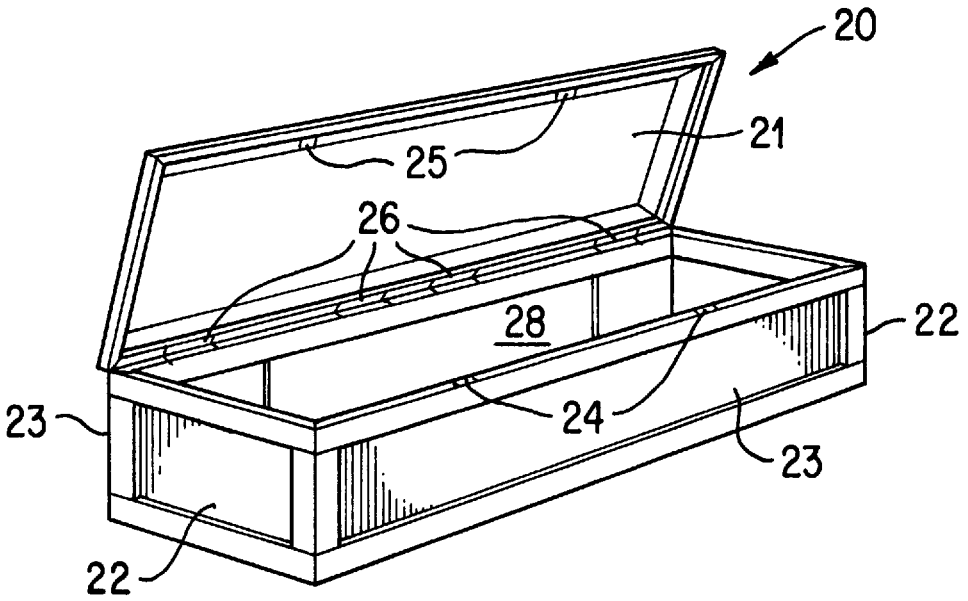
FIG. 2 is a perspective view of a single-lid or full-lid casket in the open condition.
Figure 4:
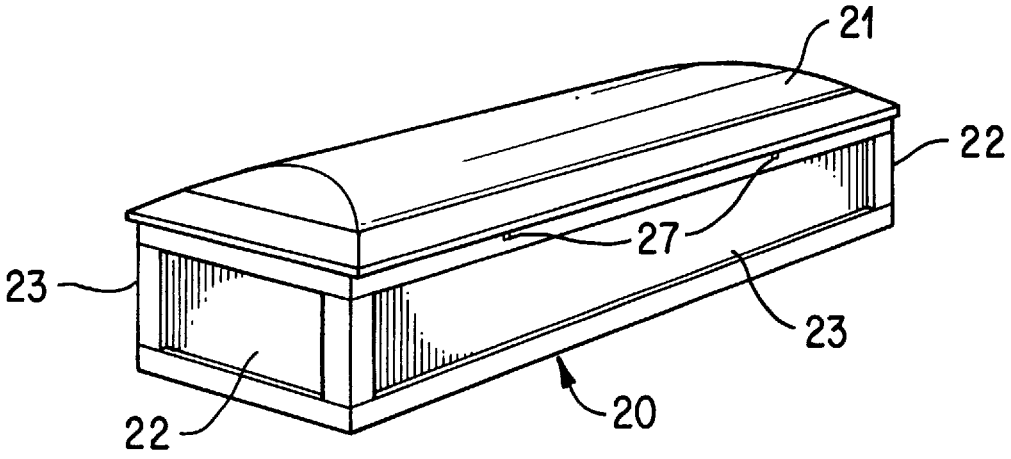
FIG. 4 is a perspective view of the casket of FIG. 2 in the closed condition.

FIGS. 2 and 4 are perspective views of the single-lid or full-lid casket in the open condition and closed condition, respectively. As seen therein, the single-lid or full-lid casket 20 comprises a lid 21, end walls 22, side walls 23, metal latches 24 and 25, and corrugated fiberboard hinges 26. Thumb latches 27 are also provided, as illustrated in FIG. 4.

Thus, FIG. 2 illustrates the assembled version of the single-lid or full-lid casket in the open position. The latter view shows the preprinted corrugated fiberboard exterior of the casket 20 supported by wood and foam pieces (not shown). Also seen in FIG. 2 is the unadorned interior 28 of the casket 20.

With respect to FIGS. 1-4, corrugated fiberboard is a structure formed by gluing one or more sheets of fluted corrugated medium to one or more flat facings of linerboard Two of the most common types of corrugated fiberboard—single-wall and double-wall—are used in preferred embodiments of the present invention.

Single-wall corrugated fiberboard comprises two flat facings of linerboard, one glued to each side of a fluted sheet of corrugated medium. Double-wall corrugated fiberboard comprises three flat facings of linerboard with two interleaved and glued sheets of fluted corrugated medium. For this description, the term "quad-wall" refers to two sheets of double-wall corrugated fiberboard glued together so that the direction of corrugation of one sheet is perpendicular to the direction of corrugation of the other sheet. The adjective "preprinted" as used herein describes or denotes a flat facing of linerboard that is printed before being glued to the corrugated medium.

Figure 5:
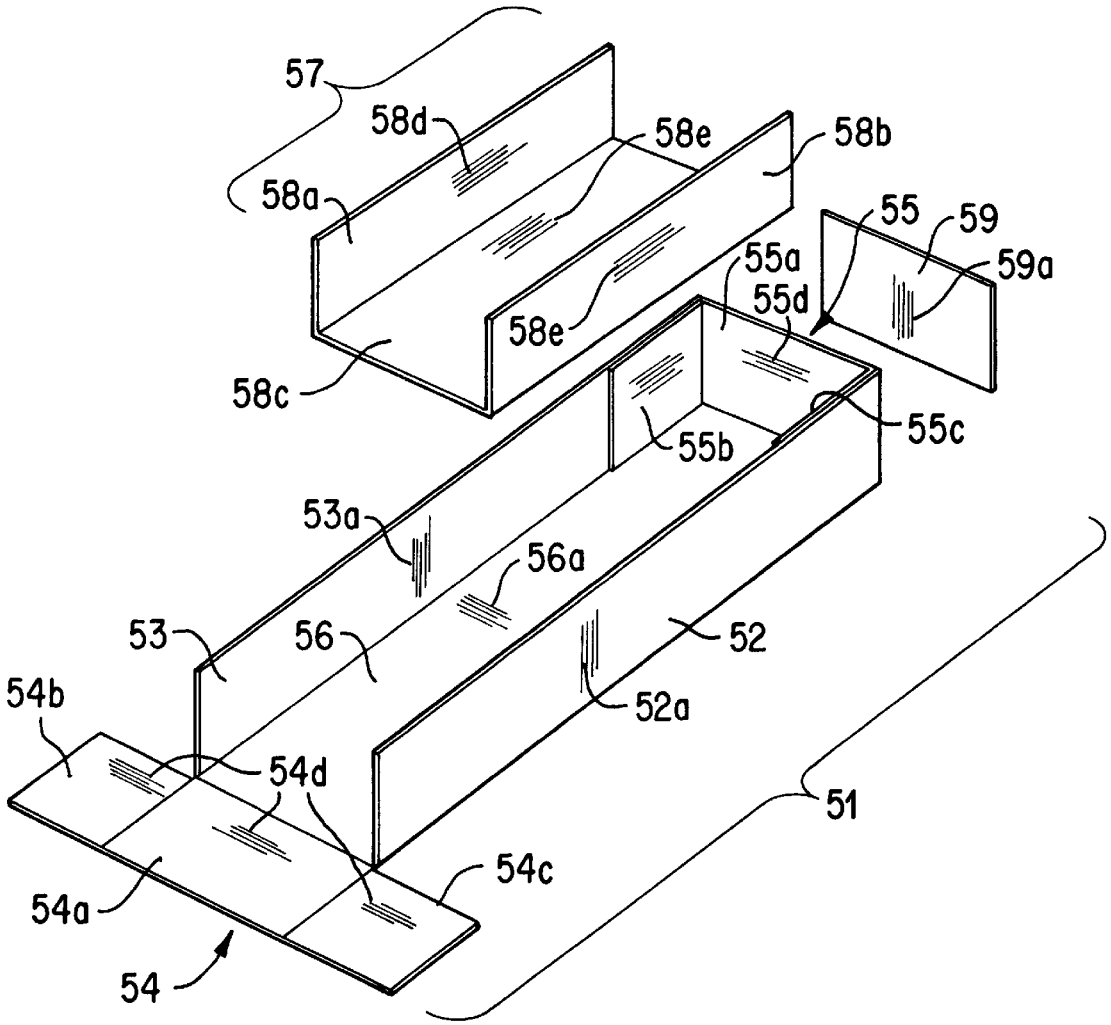
FIG. 5 is a perspective view of various internal components of the casket of the present invention.

FIG. 5 is a perspective view of various internal components of the casket of the present invention. As seen therein, a tray 51 comprises side panels 52 and 53, end panels 54 and 55, and end pads associated with each of the end panels, only end pad 59 being shown in FIG. 5.

As further seen in FIG. 5, side panels 52 and 53 have corrugations 52*a* and 53*a* extending in the vertical direction. End panels 54 and 55 comprise main portions 54*a* and 55*a*, respectively, on either side of which are disposed flanges 54*b*, 54*c* and 55*b*, 55*c*, respectively. Each of the end panels 54 and 55 has corrugation 54*d* and 55*d*, respectively, extending in the horizontal direction. The bottom panel 56 of tray 51 has horizontal corrugation 56*a* extending in the lateral direction.

Also seen in FIG. 5 is an insert 57 having side panels 58*a* and 58*b* connected by a bottom panel 58*c*. Side panels 58*b* and 58*d* have corrugations 58*d* and 58*e*, respectively, extending in the longitudinal direction, while bottom panel 58*c* has horizontal corrugation 58*e* extending in the longitudinal direction. Finally, the pad 59 has vertically extending corrugation 59*a*.

Further referring to FIG. 5, the tray 51 is a specially slotted sheet of double-wall corrugated fiberboard. During assembly of the tray 51, flanges 54*b* and 54*c* are folded into the upright position and then, as the main portion 54*a* is raised to the vertical position, flanges 54*b* and 54*c* are positioned next to and are glued to the inside of side panels 52 and 53, respectively. A similar assembly process takes place with respect to the end panel 55, its main portion 55*a* and flanges 55*b* and 55*c*.

The insert 57 is a scored sheet of double-walled corrugated fiberboard which, as previously mentioned, is longitudinally corrugated. During the assembly process, the bottom panel 58*c* of insert 57 is glued to the inside face of the bottom panel 56 of the tray 51 so that the forward and rear edges of the side panels 58*a* and 58*b* abut the interior edges of the flanges 54*b*, 54*c* and 55*b*, 55*c*. Furthermore, the side panels 58*a* and 58*b* of insert 57 are glued to the interior of the side panels 52 and 53, respectively, of the tray 51, while the bottom panel 58*c* of insert 57 is glued to the interior of the bottom panel 56 of the tray 51, so that the forward and rear edges of the side panels 58*a* and 58*b* abut the interior edges of the flanges 54*b*, 54*c* and 55*b*, 55*c*, respectively, of the tray 51. The gluing of the insert 57 to the tray 51 completes the quad-wall structure of the long sides of the casket body, as will be seen with reference to FIG. 6. That is to say, the combination of the laterally corrugated tray 51 and the longitudinally corrugated insert 57 provides strength to the sides of tile casket body, as well as the weight bearing areas of the bottom of the casket body. This quad-wall structure allows the attachment of carrying handles and distributes the weight of any contents along the sides of the completed shell.

Further referring to FIG. 5, the pad 59 comprises a sheet of double-wall corrugated fiberboard. Pad 59 is glued to the end panel 55, and a similar pad (not shown) is glued to end panel 54. Moreover, the edge portions of the pad 59 are also glued to the edges of the side panels 52 and 53 of the tray 51.

It will be noted that the pad 59 has corrugation 59*a* running vertically when it is in place. The pad 59 completes the quad-wall structure of the ends of the casket body. As was the case with the quad-wall structure of the sides of the completed shells, the ends distribute the weight of the contents along the breadth of the completed casket shell.

Figure 6:
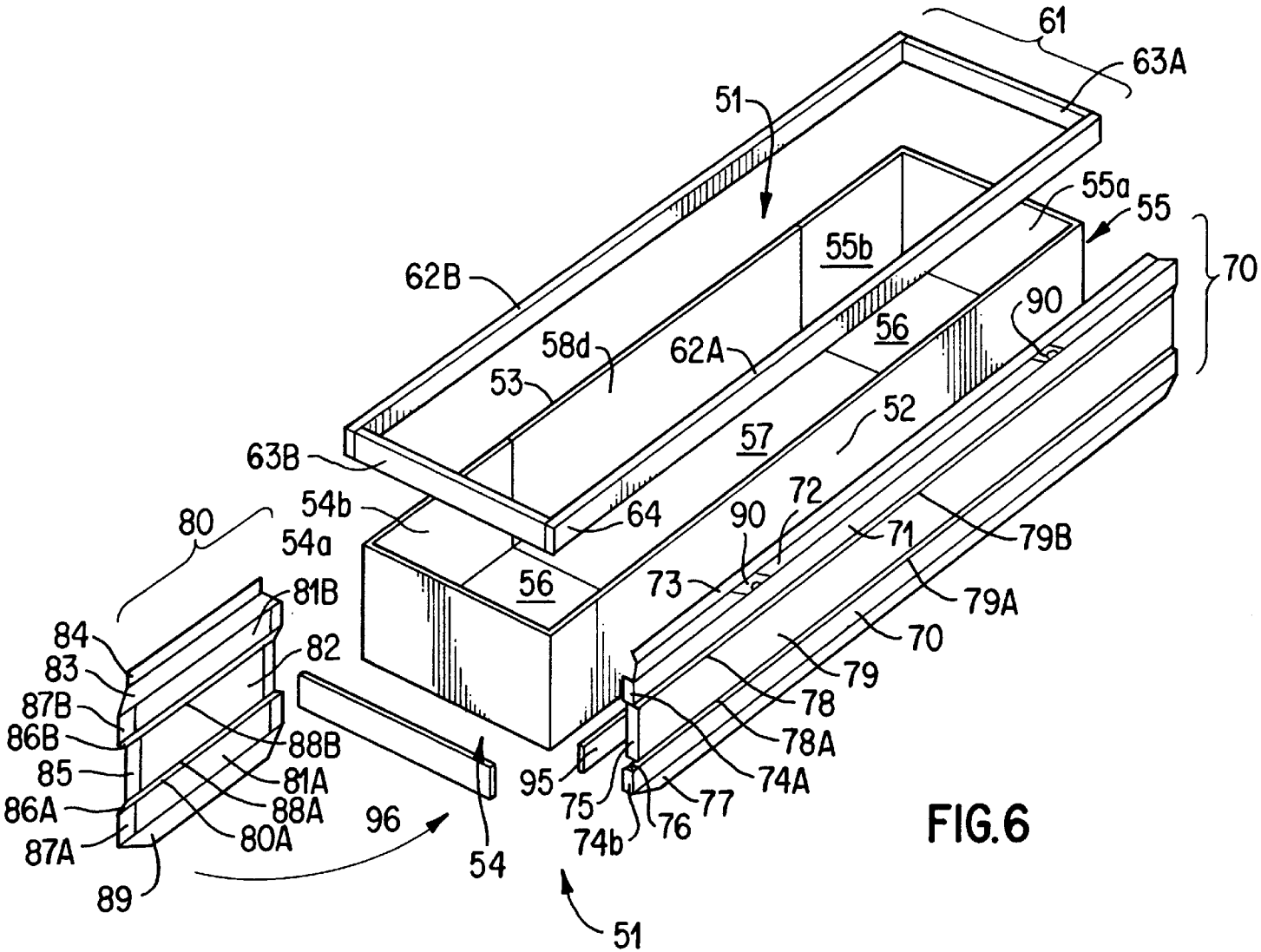
FIG. 6 is a perspective view of the components of FIG. 5, as assembled, in combination with other components of the casket of the present invention.

FIG. 6 is a perspective view of the components of FIG. 5, as assembled, in combination with other components of the casket of the present invention. As seen therein, assembly of the casket of the present invention continues by applying, to the previously assembled tray 51 and insert 57 (assembly of which was described above with reference to FIG. 5), a frame 61, side wrap 70, and end wrap 80, as well as associated components. It should be recognized that a pad 59 (FIG. 5) is fixed to the exterior of each end wall 54, 55 (FIG. 6), but the pads 59 have been excluded from FIG. 6 for the sake of simplicity.

Figure 22:
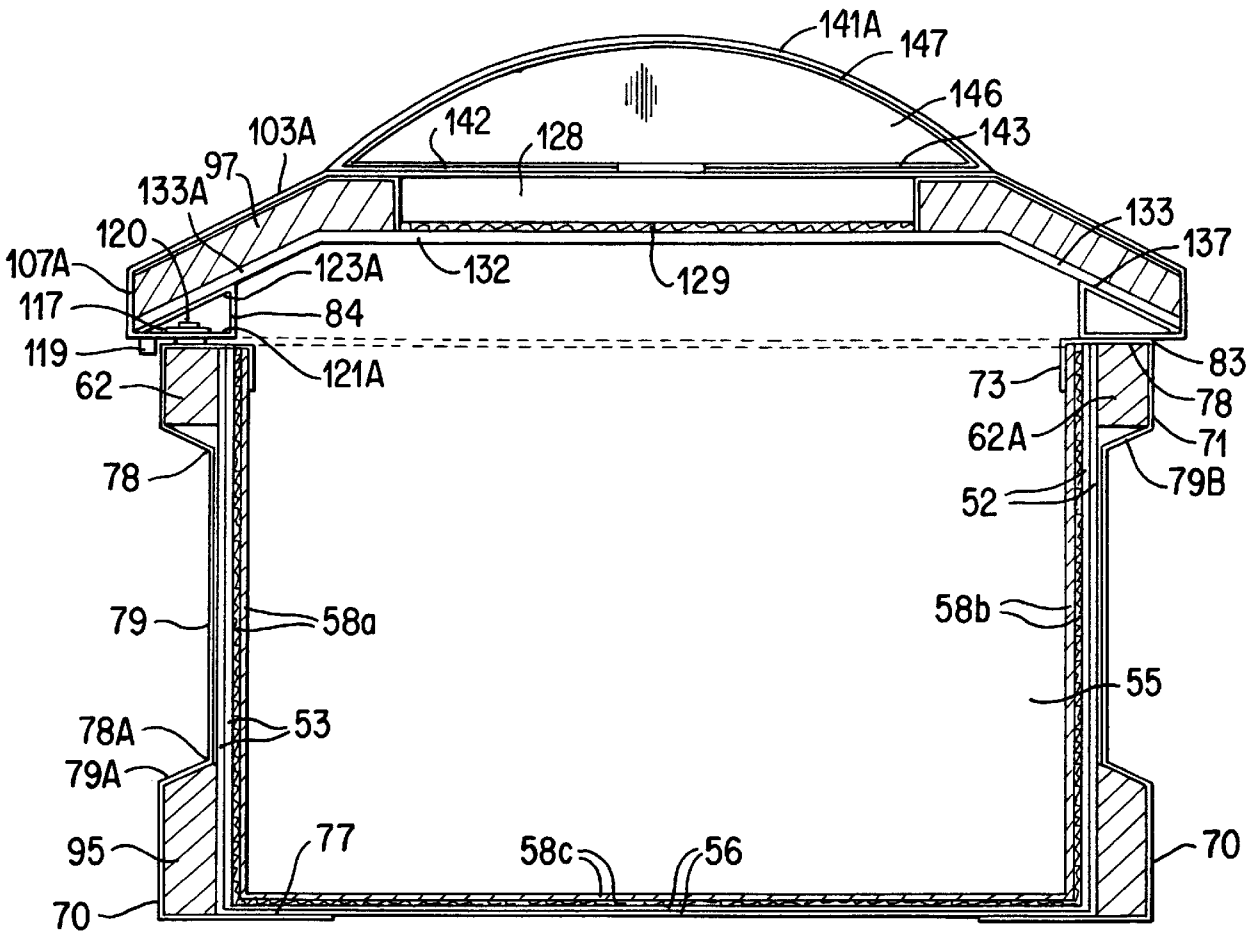
FIG. 22 is a cross-sectional, end view of the assembled casket body with a raised, flat lid and an optional, curved lid in accordance with the present invention.

More specifically, wood side pieces 62A, 62B and wood end pieces 63A, 63B are jointed together with metal staples 64 to form the frame 61. Wood side pieces 62A and 62B are identical, but only differentiate in the drawings to denote the front and rear, respectively, of the casket. The frame 61 is glued to the exterior perimeter of the assembled tray 51, as formed by the tops of the panels 52–55 and the tops of the pads 59 (as illustrated in FIGS. 6 and 22). Preferably, wood side pieces 62A, 62B and wood end pieces 63A, 63B are made of finger-jointed material or finger-jointed wood to prevent or reduce warping and to maintain straightness and rigidity.

Figure 9A:
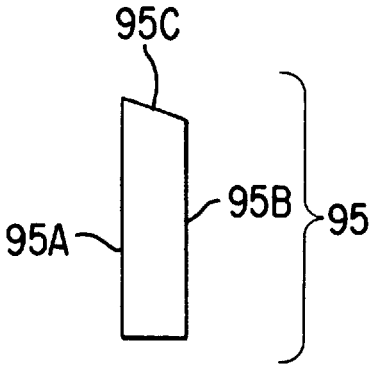
FIGS. 9A and 9B are side views of a foam side piece and a foam end piece, respectively, of the casket of the present invention.

As seen in FIG. 9A, which is a side view of the foam side piece of the casket of the present invention, foam pieces 95 are beveled pieces of 1.0 lb. expanded polystyrene. Faces 95A of the foam pieces 95 are glued to the bottoms of the side panels 52 and 53 of the tray 51 (FIG. 5). The density and weight characteristics of foam pieces 95 provide the necessary structure for attachment of side wraps 70 (FIG. 6), while keeping the overall weight of the casket body low. The foam pieces 95 incinerate at a higher temperature and with less residue than the wood or corrugated components of the casket body, and this is an obvious advantage during cremation.

Figure 9B:
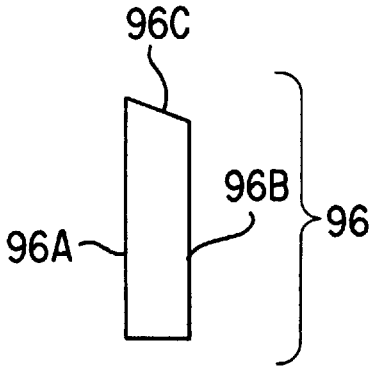

Referring to FIG. 9B, which is a side view of a foam end piece of the casket of the present invention, the foam pieces 96 are beveled pieces of 1.0 lb. expanded polystyrene. The faces 96A of the foam pieces 96 are glued to the bottoms of the pads 59 and to the ends of the foam pieces 95, thereby completing the foam perimeter of the assembled tray 51 (see FIG. 6). The density and weight characteristics of the foam pieces 96 provide the necessary structure for attachment of end wraps 80, while keeping the overall weight of the casket body down. The foam pieces 96 incinerate at a higher temperature and with less residue than the wood or corrugated components of the casket body, and this is a clear advantage during cremation.

Side wraps 70 are scored and die-cut sheets of preprinted single-wall corrugated fiberboard, and one side wrap 70 is fixed to each of the side panels 52 and 53 of FIG. 6. As shown in detail in FIG. 7, which is a plan view of the side wraps of the casket of the present invention, the side wrap 70 is back-folded at scores 78 and 78A prior to being attached to the assembled tray 51. The panels 79 of the side wrap 70 are glued to the side panels 52 and 53 of the tray 51 and to the edges of the pads 59 by aligning the score 78A with an apex of the faces 95A (FIG. 9A) of the foam pieces 95, as illustrated in FIGS. 6 and 22. The panels 79A of the side wraps 17 are glued to the beveled edges 95C (FIG. 9A) of the foam pieces 95, as illustrated in FIGS. 6 and 22. The panels 70 (FIG. 7) of the side wraps 70 are glued to the faces 95B (FIG. 9A) of the foam pieces 95, as further illustrated in FIGS. 6 and 22. The panels 71 (FIG. 7) of the side wraps 70 are glued to the exterior faces of wood side pieces 62A and 62B, as illustrated in FIGS. 6 and 22. The panels 72 (FIG. 7) of the side wraps 70 are glued to the top of wood side pieces 62A and 62B of the frame 61, as well as to the top edges of the panels 52 and 53 of the tray 51 and to the top edges of the side panels 58*a* and 58*b* of the insert 57, as illustrated in FIGS. 5, 6 and 22. The panels 73 (FIG. 7) of the side wraps 17 are glued to the interior of the flanges 54*b*, 54*c*, 55*b* and 55*c* of the tray 51 and to the interior of the side panels 58*a* and 58*b* of the insert 57, as seen in FIGS. 5, 6 and 22.

The tabs 74*a* (FIG. 7) of the side wraps 70 are glued to the ends of the wood side pieces 62A and 62B and to the exterior faces of the wood end pieces 63A and 63B of frame 61, as illustrated in FIG. 6. The tabs 75 (FIG. 7) of the side wraps 70 are glued to the pads 59, as also illustrated in FIG. 6. The tabs 74*b* (FIG. 7) of the side wraps 70 are glued to the faces 96B (FIG. 9B) of foam pieces 96. The tabs 76 (FIG. 7) of side wraps 70 are placed in such a position as to cover the triangular gap created by panels 79B (FIGS. 6 and 7) of the side wraps 70, as illustrated in FIG. 22. The panels 77 (FIG. 7) of side wraps 70 are glued to the exterior of the bottom panel 56 of the tray 5 1, as illustrated in FIGS. 5, 6 and 22.

Figure 8:
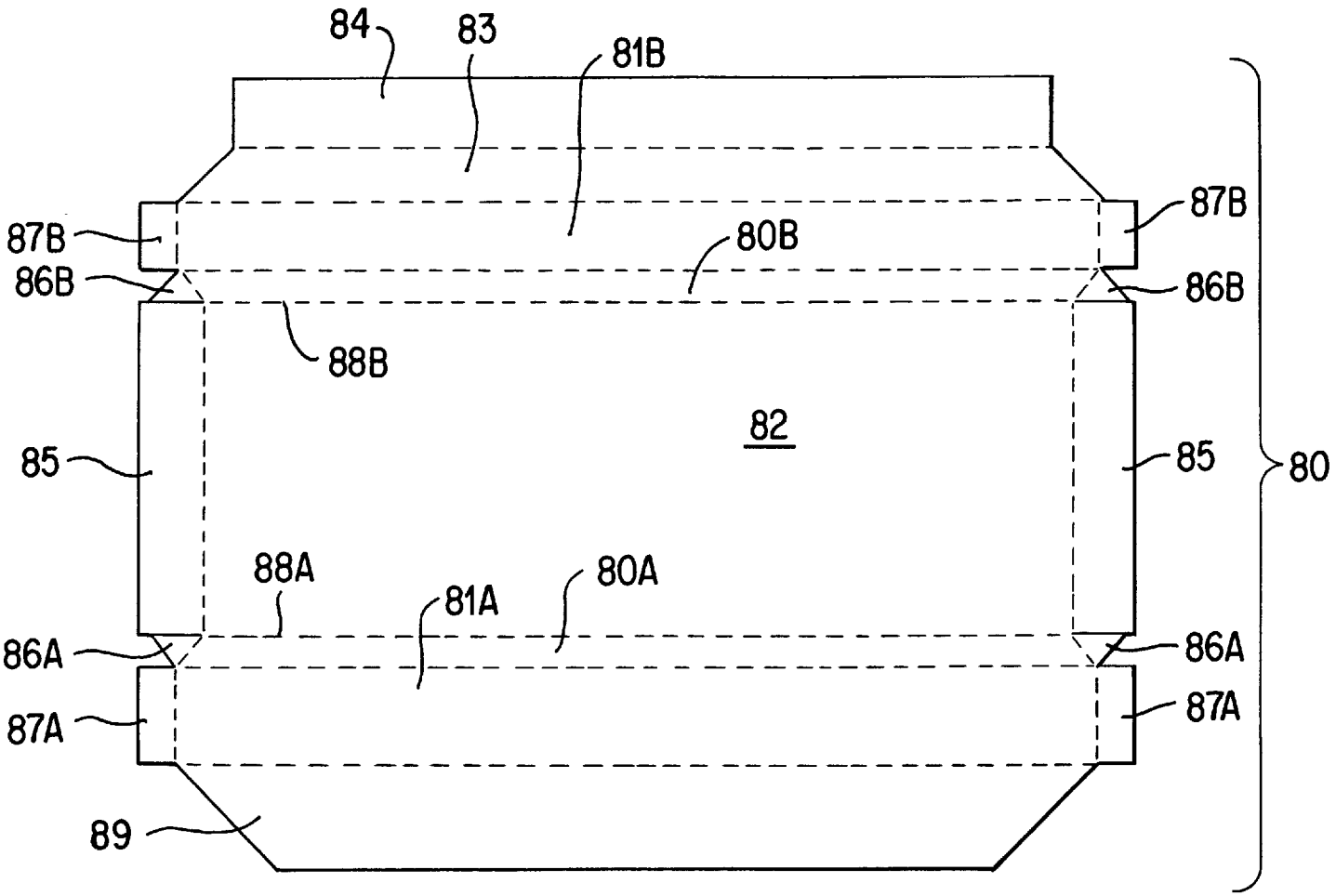
FIG. 8 is a plan view of the end wraps of the casket of the present invention.

FIG. 8 is a plan view of the end wraps of the casket of the present invention. The end wraps 80 are scored, die-cut sheets of preprinted, single-wall fiberboard. Moreover, end wraps 80 are back-folded at scores 88A and 88B prior to being attached to the assembled tray 51 (see FIG. 6). Tabs 85 (FIG. 8) of end wraps 29 are folded and glued to the kraft faces of the panels 82 of end wrap 80, as illustrated in FIG. 6. Tabs 87B (FIG. 8) of end wraps 80 are folded and glued to the kraft faces of the panels 81 B, as illustrated in FIG. 6. Tabs 87A (FIG. 8) of end wraps 80 are folded and glued to the panels 81A, as illustrated in FIG. 6. The folded and glued tabs 85, 87A and 87B provide a preprinted edge for the assembled casket body.

The panels 82 (FIG. 8) of end wraps 80 are glued to the pads 59 and to the tabs 74*b* (FIG. 7) of side wraps 70 by aligning the scores 88A (FIG. 8) with the apex of the faces 96A (FIG. 9B) of the foam pieces 96, as illustrated in FIG. 6. The panels 80A (FIG. 8) of end wraps 80 are glued to the beveled edges 96*c* of the foam pieces 96 (FIG. 9B), as illustrated in FIG. 6. The panels 81A (FIG. 8) of end wraps 80 are glued to the faces 96B (FIG. 9B) of the foam pieces 96 and to the tabs 74*b* (FIG. 7) of the side wraps 70, as illustrated in FIG. 6. The panels 81B (FIG. 8) of end wraps 80 are glued to the exterior faces of wood end pieces 63A and 63B (FIG. 6) and to the tabs 74*a* (FIG. 7) of side wraps 70, as illustrated in FIG. 6. Panels 83 (FIG. 8) of end wraps 80 are glued to the top of wood side pieces 62A, 62B and wood end pieces 63A, 63B so that the edges thereof abut the edges of the panels 72 (FIG. 7) of side wraps 70, as illustrated in FIGS. 1–4. Panels 84 (FIG. 8) of end wraps 80 are glued to the interior of end panels 54 and 55 (FIG. 5) of the tray 51 so that the edges thereof abut the edges of the panels 73 (FIG. 7) of side wraps 70. The panels 89 (FIG. 8) of end wraps 80 are glued to the exterior of bottom panel 56 (FIG. 5) of tray 51 so that they abut the edges of the panels 77 (FIG. 7) of the side wraps 70. The tabs 86A, 86B (FIG. 8) are glued to cover the open space left by the folding and attachment of end wraps 80, as illustrated in FIG. 6. The striker plates 90 (FIG. 6) are attached to the panels 72 of side wraps 70, as illustrated in FIG. 6.

The raised, flat-top, split-lid casket of the present invention will now be described in further detail with reference to FIGS. 9A–9D, 10, 11, 12, 21 and 22.

Figure 10:
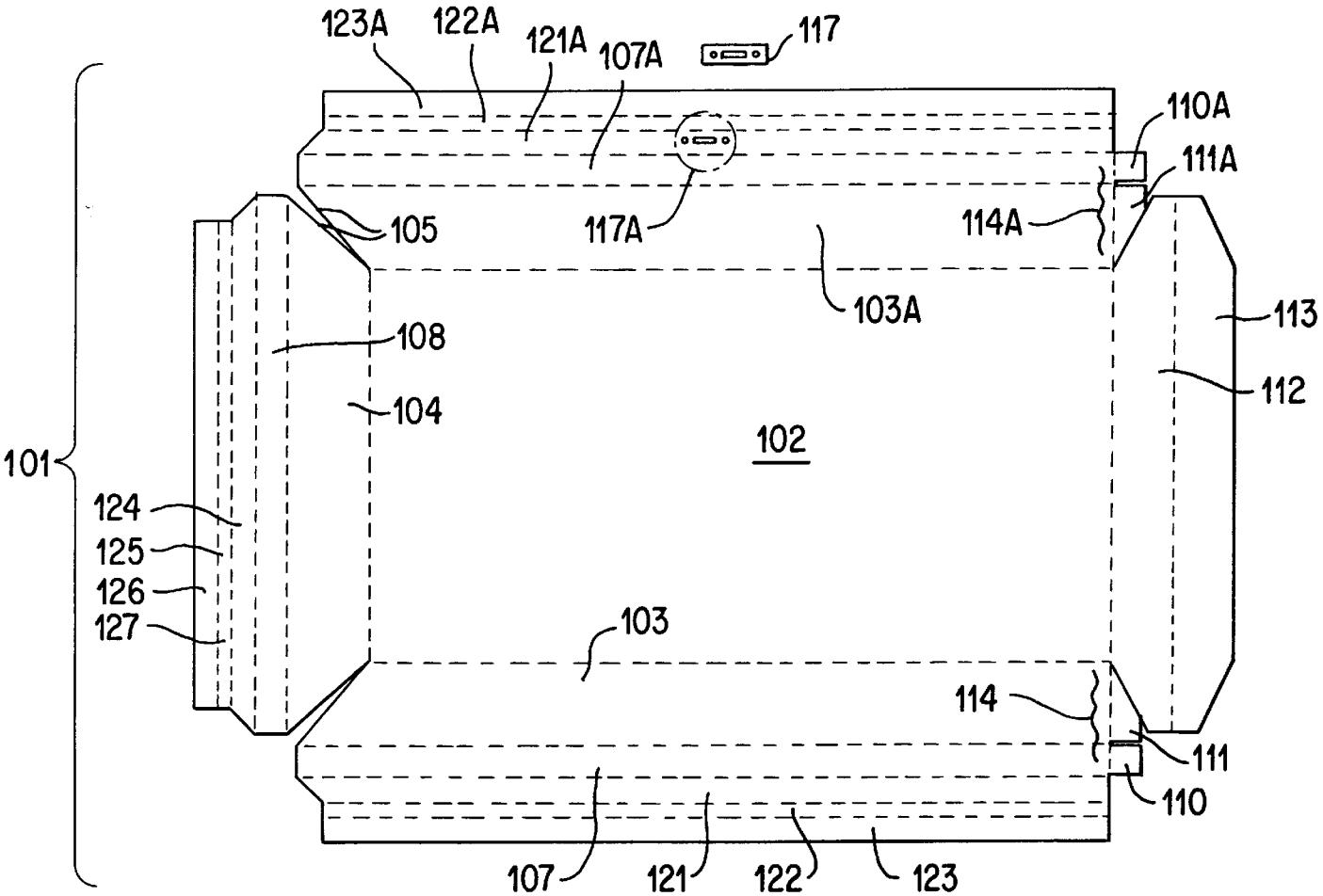
FIG. 10 is a plan view of a cut blank of corrugated fiberboard used to form the outer cover of a raised, flat, split-lid arrangement in accordance with the present invention.

As seen in FIG. 10, which a plan view of a cut blank of corrugated fiberboard used to form the outer cover of the raised, flat, split-lid casket of the present invention, lid or liner 101 is a die-cut sheet of preprinted, single-wall fiberboard. Liner 101 is placed in an assembly jig to guide the desired shape of the lid, and to increase labor efficiency. The assembly jig draws the joints 105 together, placing the panels 103, 103A and 104 at a desired angle to provide the desired rise in the lid 101, and placing panels 107, 107A, 108, 110, 110A, 111, 111A and 112 in a vertical position perpendicular to the panel 102.

Liner 101 is glued at joints 105 to form mitered corners, and to create the raised portion (FIG. 3) of the flat lid 12, as illustrated in FIGS. 1, 3, 10, 11 and 22. Corner reinforcers 106 (FIGS. 11 and 21B) comprise scored, die-cut pads of single-wall corrugated fiberboard. The corner reinforcers 106 are glued to the panels 103 and 104, and across the panels 103A and 104, of the liner 101 to provide additional strength and stability.

Reinforcers 109 (FIGS. 11 and 21C) are scored sheets of single-wall fiberboard, and are glued to the panels 107 and 108, and to the panels 107A and 108 of the liner 101. Thus, reinforcers 109 also provide additional strength and stability.

Tab 110 (FIG. 10) is folded and glued to the kraft side of panel 107 of liner 101 to provide a preprinted edge to the completed half lid 11 (FIG. 1). Tab 110A (FIG. 10) is folded and glued to the kraft side of the panel 107A of liner 101 to provide a preprinted edge to the completed half lid 11 (FIG. 1). Tab 101A (FIG. 10) is folded and glued to the kraft side of the panel 103A of liner 101 to provide a preprinted edge to the completed half lid 11 (FIG. 1).

Figure 11:
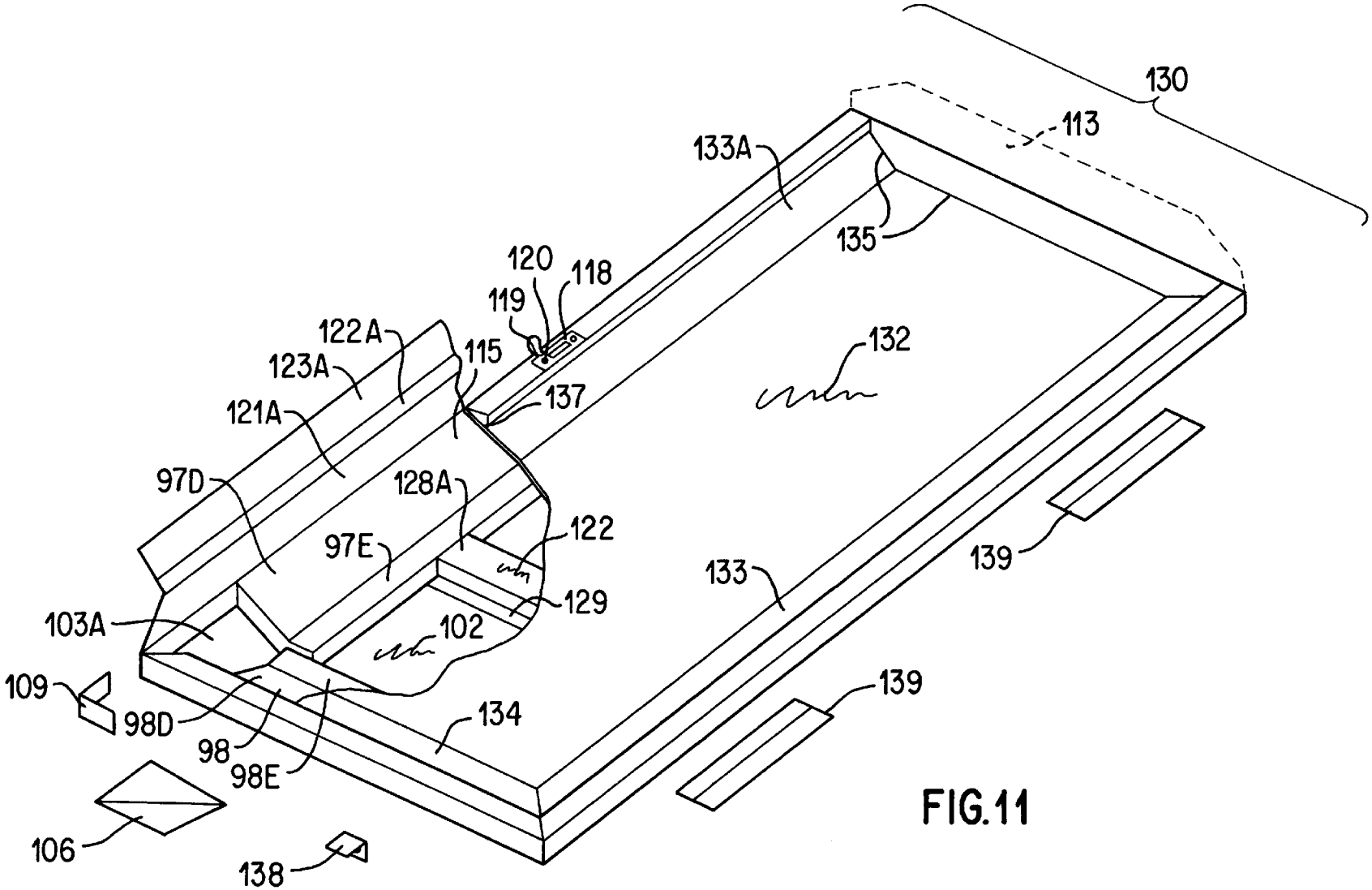
FIG. 11 is a perspective view of the underside of the assembled raised, flat lid, including cut-away views of the side structure, and showing corrugated hinges unattached.

Flange 113 (FIG. 10) is folded and glued to the panel 112 of the liner 101 to provide additional strength to, and to form a preprinted edge of, the half lid 11 of FIG. 1 (see also the assembled lid 130 of FIG. 11). Glue beads 114 and 114A (FIG. 10) cause the panel 112 and the flange 113 to adhere to the preprinted surface of tabs 11 and 111A.

Foam struts 97 (FIG. 9C) are cut pieces of 1.5 lb. expanded polystyrene, and have a cross-section similar to that illustrated in FIG. 9A. Faces 97A, 97B and 97C of foam struts 97 are glued to the panels 102, 103 and 107, respectively, of the liner 101, and to the panels 102, 103A and 107A, respectively, of the liner 101 (see FIG. 10), so that the ends of the foam struts 97 are glued to the previously folded flange 113. This positioning preserves the shape of the lid by filling the void which otherwise would have been created by the yet-to-be-folded remaining panels of the liner 101. The presence of the struts 97 provides strength, and maintains the integrity of the completed lid, as illustrated in FIGS. 11 and 22.

Figure 9C:
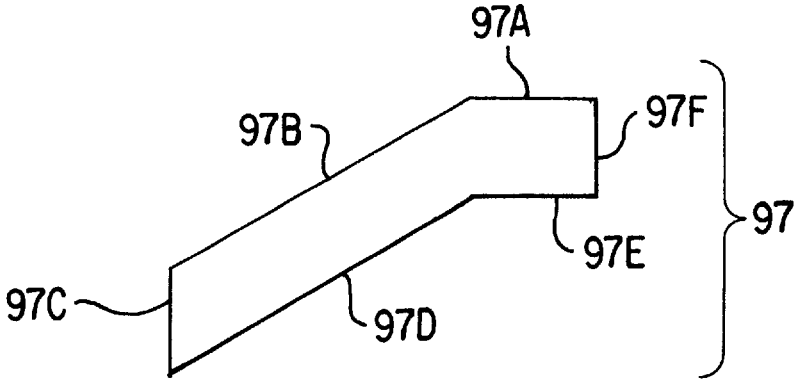
FIGS. 9C and 9D are perspective views of foam pieces used in the liner or lid of the casket of the present invention.
Figure 9D:
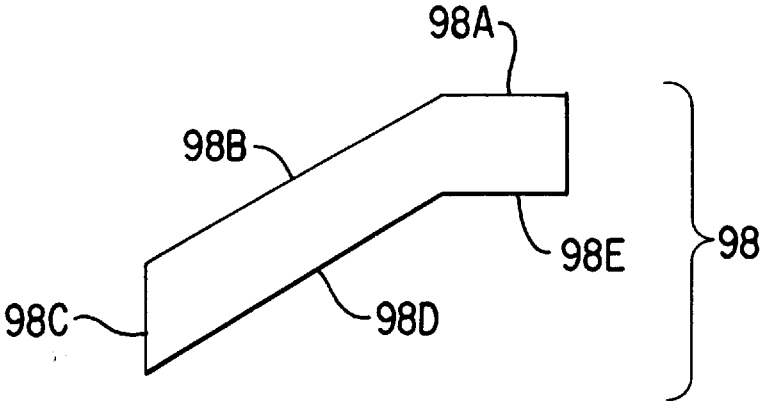

Foam strut 98 (FIG. 9D) is a cut piece of 1.5 lb. expanded polystyrene, and has a cross-section similar to that illustrated in FIG. 9D. The faces 98A, 98B and 98C of foam strut 98 are centered and glued to the panels 102, 104 and 108, respectively (FIGS. 10 and 11). This positioning preserves the shape of the lid by filling the void that otherwise would have been created by the yet-to-be-folded remaining panels of the liner 101. The foam strut 98 (FIG. 9D) provides strength and maintains the integrity of the completed lids, as illustrated in FIG. 11. The presence of the 1.5 lb. expanded polystyrene keeps the overall weight of the lid at a minimum. The foam struts 97 and 98 (FIGS. 9C and 9D) incinerate at a higher temperature, and with less residue, than the wood or corrugated components of the casket lid.

Referring to FIGS. 10 and 11, the metal inner striker plate 117, the metal outer striker plate 118, and the metal thumb latch 119 are attached to the panel 121A of liner 101 with metal rivets 120 inserted through die-cut holes 117A. The plates 117 and 118 create a bearing surface for the latch 1 19. The results of this assembly are illustrated in FIG. 22.

Beams 128 (FIG. 21D) are scored sheets of single-wall corrugated fiberboard. The beams 128 are prefolded to increase their assembly efficiency. Two beams 128 are spaced equidistantly between the foam strut 98 (FIG. 9D) and the flange 113 (FIG. 10). The faces 129 of the beams 128 (FIG. 21D) are glued to the panel 102 of liner 101 (FIG. 10) so that the ends of the beams 128 abut the faces 97F of the foam struts 97 (FIG. 9C).

Figure 12:
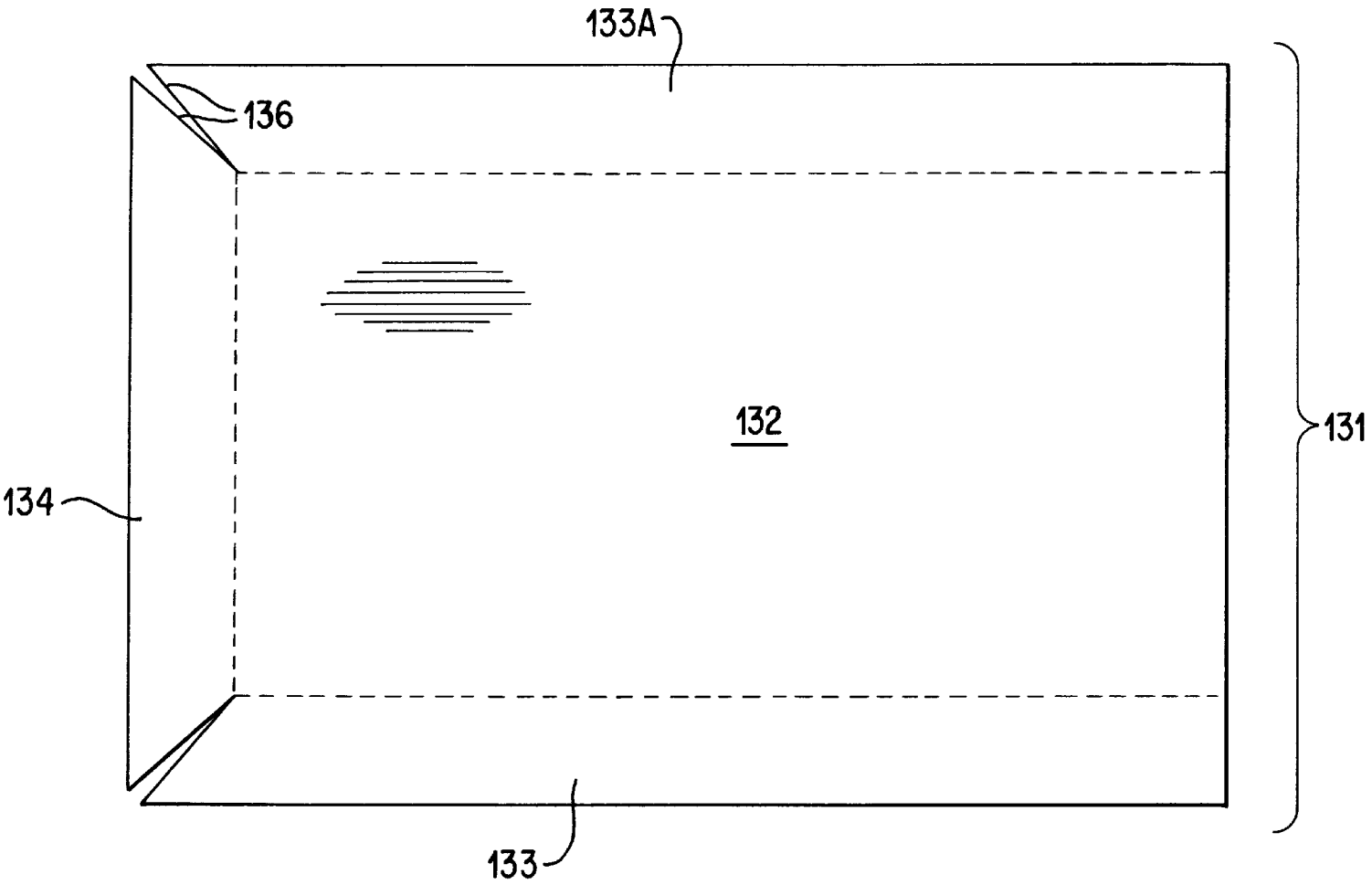
FIG. 12 is a plan view of a cut blank of corrugated fiberboard used to form the inner panel of a raised, flat, split-lid arrangement in accordance with the present invention.

Referring to FIG. 12, which is a plan view of the inner panel or liner of the raised flat-split lid of the present invention, the liner 131 is a scored and die-cut sheet of single-wall corrugated fiberboard. Liner 131 is attached to the assembled lid 130 (FIG. 11) by gluing the panel 132 of liner 131 to the faces 128A of beams 128, to the faces 97E of foam struts 97, and to the face 98E of foam strut 98, as illustrated in FIGS. 11 and 22. A glue bead 135 is placed along the open end of the panel 132 of liner 131, and is applied to the adjacent edges of the panels 133 and 133A of the liner 131 to adhere it to the flange 1 13 of the liner 101, as illustrated in FIG. 10 and 11. Glue beads 136 join the edges of panels 133 and 134 of liner 131, as well as the edges of the panel 133A and 134 of the liner 131, as illustrated in FIG. 12. Panels 133 and 133A of liner 131 are glued to the faces 97D of foam struts 97, as illustrated in FIGS. 10, 11 and 22. The panel 134 is glued to the face 98D of strut 98, as illustrated in FIG. 11.

Panels 121A, 122A and 123A of the liner 101 (illustrated in FIGS. 11 and 22) are folded inward until the panel 121A is perpendicular to the panel 107A, and a triangle is formed by gluing the outer edge of the panel 123A to the interior of the score between the panels 107A and 121 A, as illustrated in FIGS. 10, 11 and 22. The completed fold creates a space between the preprinted face of the panel 123A of liner 101 and the panel 133A of liner 131, as illustrated in FIG. 22. This space accommodates the decorative panel of the finished casket shell. The panels 121, 122 and 123 of liner 101 are folded inward until the panel 121 is perpendicular to the panel 107, and a triangle is formed by gluing the outer edge of the panel 123 to the interior of the score between the panels 107 and 121, as illustrated in FIGS. 10, 11 and 22. The completed fold creates a space between the preprinted face of the panel 123 of liner 101 and the panel 133 of liner 131, as illustrated in FIG. 22. This space accommodates the decorative panel of the finished casket shell.

Metal bracket 138 (FIG. 11) is attached to the kraft side of panels 124 and 125 (see FIG. 10), aligning the die-cut hole 127 with the hole in the metal bracket 138. The metal bracket 138 allows the attachment of an arm support for the casket lid should such be desired. The panels 124, 125 and 126 of the liner 101 are folded inward until the panel 124 is perpendicular to the panel 108, and a triangle is formed by gluing the outer edge of the panel 126 to the interior of the score between the panels 108 and 124, as illustrated in FIGS. 10, 11 and 22. The completed fold creates a space between the preprinted face of the panel 126 of the liner 101 and the panel 134 of the liner 131. This space accommodates the decorative panel of the finished casket shell.

Figure 21A:
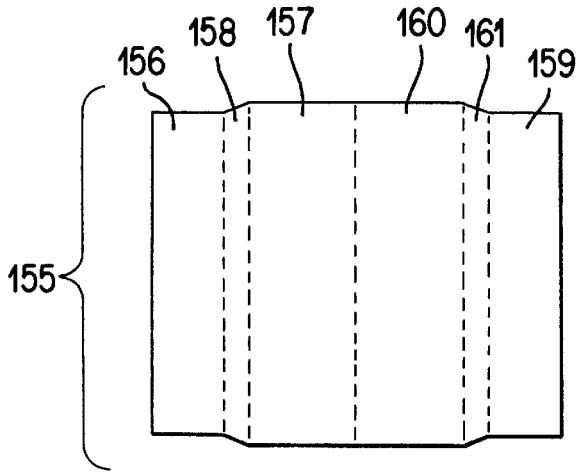
FIGS. 21A–21E are plan views of the cut blanks of corrugated fiberboard prepared for the formation of the hinges, the corner supports of the lid (two types), the beam supports of the lid, and the optional corner moldings, respectively, of the present invention.
Figure 21B:
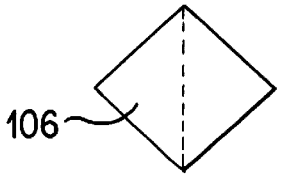
Figure 21C:
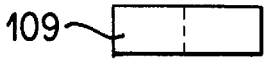
Figure 21D:
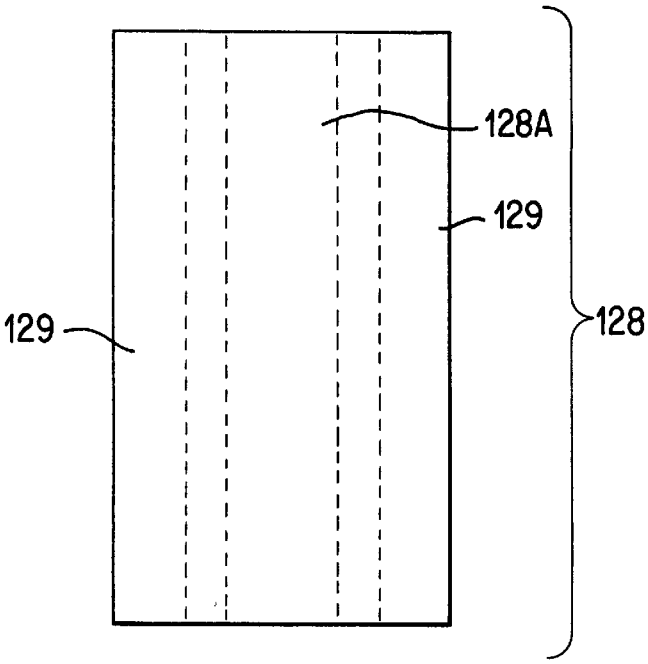
Figure 21E:
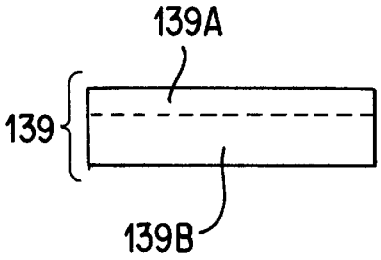

The assembled casket lid 130 is illustrated in FIG. 11, and can be attached to the assembled casket shell illustrated in FIG. 6 using the corrugated hinges 139 shown in detail in FIGS. 11 and 21E. The preprinted sides of the panels 139A (FIG. 21E) of the hinges 139 are glued to the preprinted sides of the panels 121 and 121A (FIG. 10) of the assembled lid 101, while the preprinted sides of the panels 139B (FIG. 21E) of the hinges 139 are glued to the panels 72 (FIG. 7) of the side wrap 70 of the assembled casket shell. The attachment of hinges 139 is further illustrated in FIG. I (elements 17) and in FIG. 2 (elements 26).

Figure 18:
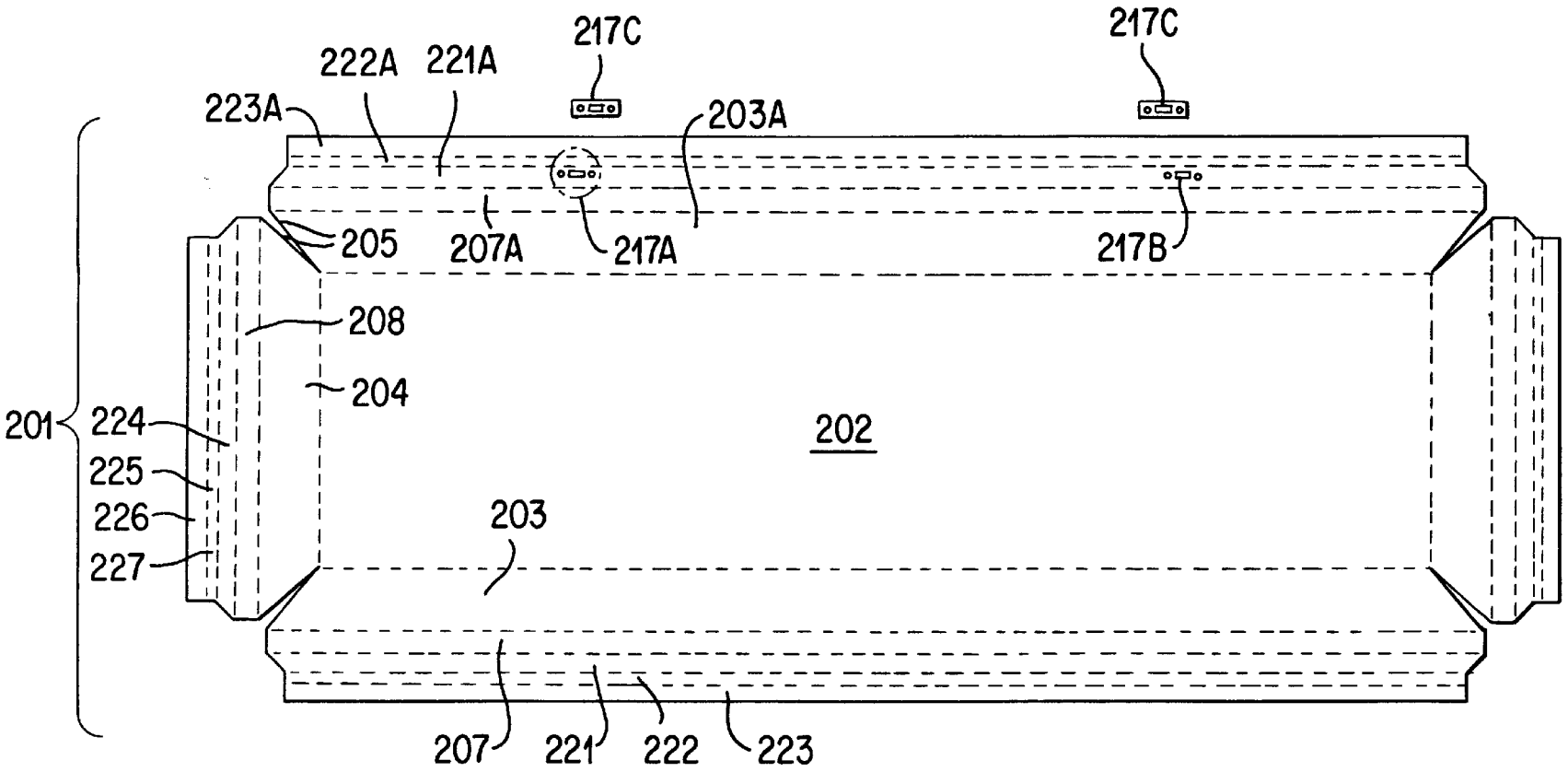
FIG. 18 is a plan view of Cut blank of corrugated fiberboard used to form the outer cover of the raised, flat, full-lid arrangement of the present invention.
Figure 19:
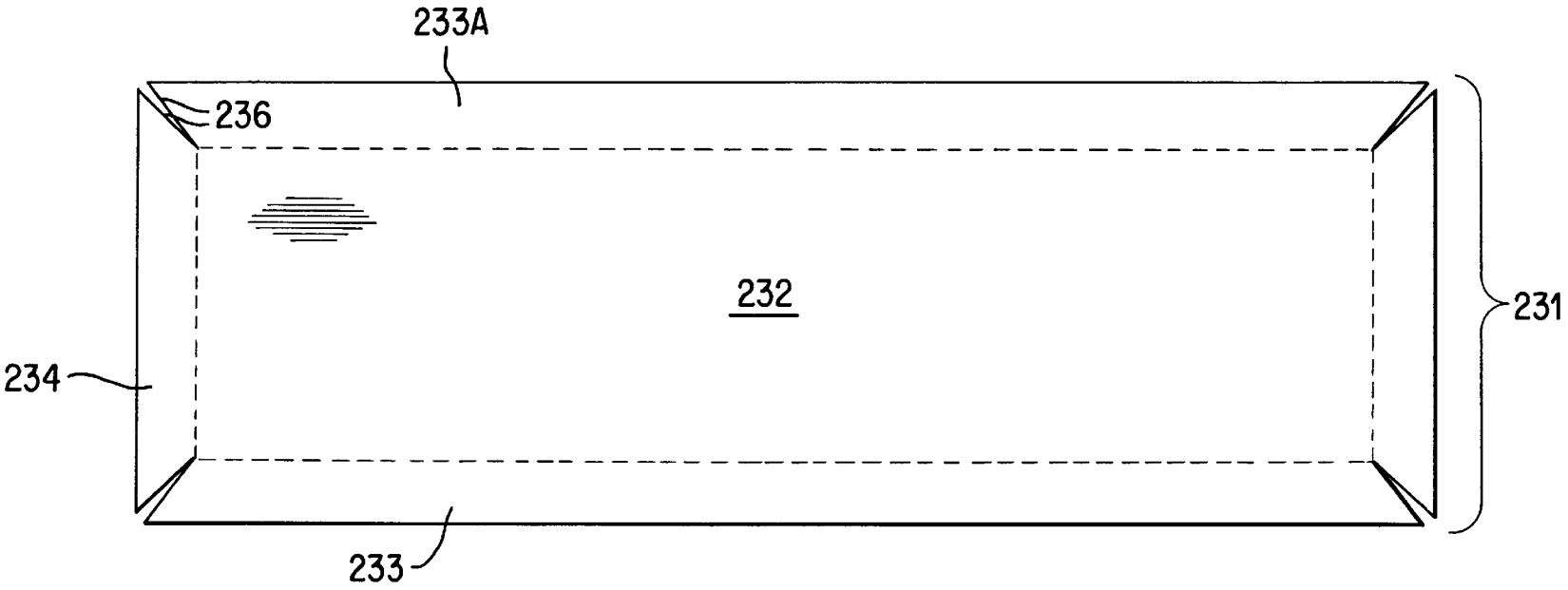
FIG. 19 is a plan view of a cut blank of corrugated fiberboard used to form the inner panel of the raised, flat, full-lid arrangement of the present invention.

As mentioned previously, a further embodiment of the invention comprises the raised, flat, full-lid casket as shown in FIGS. 2 and 4. The assembly of that embodiment of the invention is the same as the above-described assembly of the raised, flat, split-lid casket of FIGS. 1 and 3 with several adjustments. Specifically, for the raised, flat, full-lid arrangement of FIGS. 2 and 4, the raised, flat, full-lid liner 201 of FIG. 18 is used instead of the raised, flat, split-lid 101 of FIG. 10, and the raised, flat, full-lid inner panel 131 of FIG. 19 is used instead of the raised, flat, split-lid inner panel 131 of FIG. 12. In general, the raised, flat, full lid 201 of FIG. 18 is larger than the raised, flat, split lid 101 of FIG. 10, and the longitudinal dimensions of the corrugated pieces and the foam pieces are proportionally adjusted. In addition, the raised, flat, full lid 201 of FIG. 18 is assembled using a different assembly jig. Both ends of the raised, flat, full lid 201 of FIG. 18 are assembled in the same manner using the foam strut 98 of FIG. 9D and the panels 208, 224, 225 and 226 of FIG. 18. In the latter regard, it should be noted that, whereas the raised, flat, split lid 101 of FIG. 10 has a different construction at one end (panels 104, 108, 124, 125, 126 and 127) compared to the other end (panels 112 and 113), the raised, flat, full lid 201 of FIG. 18 is identically constructed at each end, with panels 204, 208 and 224–227 being provided at both ends.

In addition, the raised, flat, full lid 201 of FIG. 18 has two latch assemblies, as indicated by the pair of die-cut holes 217A and 217B and corresponding inner striker plates 217C and 217D shown in FIG. 18. Furthermore, the raised, flat, full lid 201 of FIG. 18 is attached to the casket body with four hinges (not shown in FIG. 18) similar to the pair of hinges 139 as shown in FIG. 11 for the split-lid arrangement.

The optional, curved, split lid of the casket of the present invention will now be described in more detail with reference to FIGS. 1, 3, 13A, 13B and 14–17. As seen in FIG. 15, the curve shell 141 is a die-cut sheet of preprinted, single-wall, corrugated fiberboard, as detailed in FIG. 15. Lines 141B indicate the direction of corrugation of the shell 141. The curve shell 141 is placed in an assembly jig to form the desired arc in the panel 141A shown in FIG. 13A. The assembly jig places the panels 142 and 143 in a vertical position.

Figure 13A:
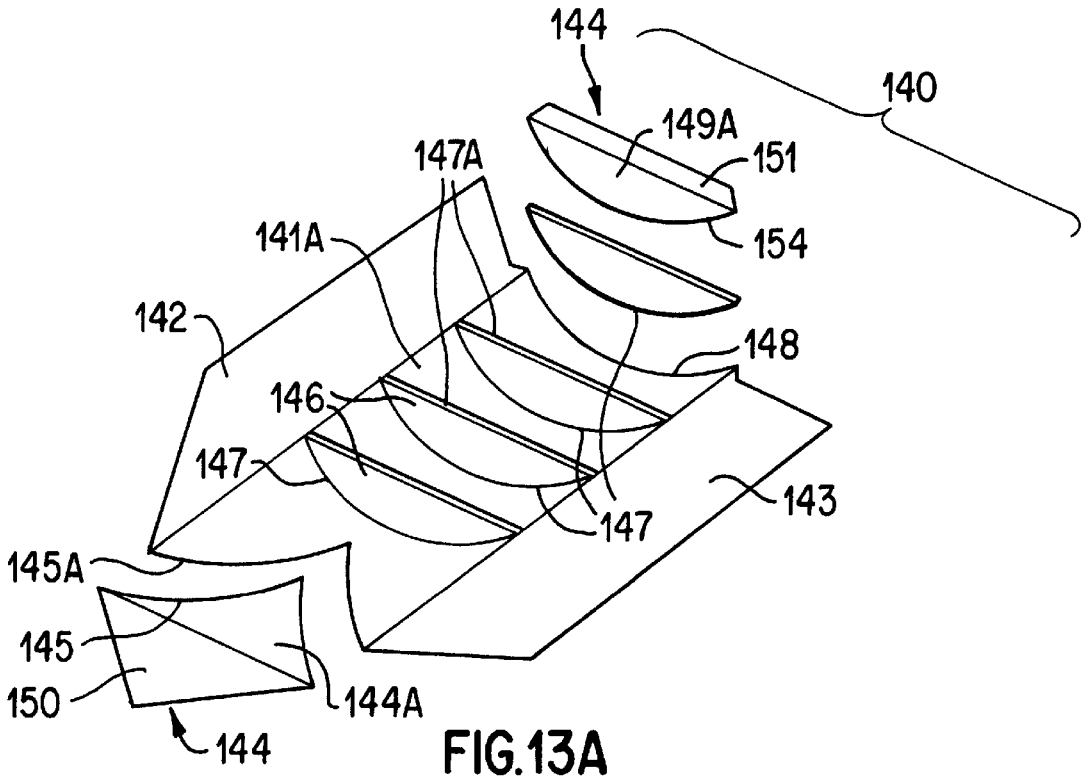
FIG. 13A is an exploded view of the corrugated fiberboard pieces of the optional, curved, split-lid arrangement of the present invention.
Figure 14:
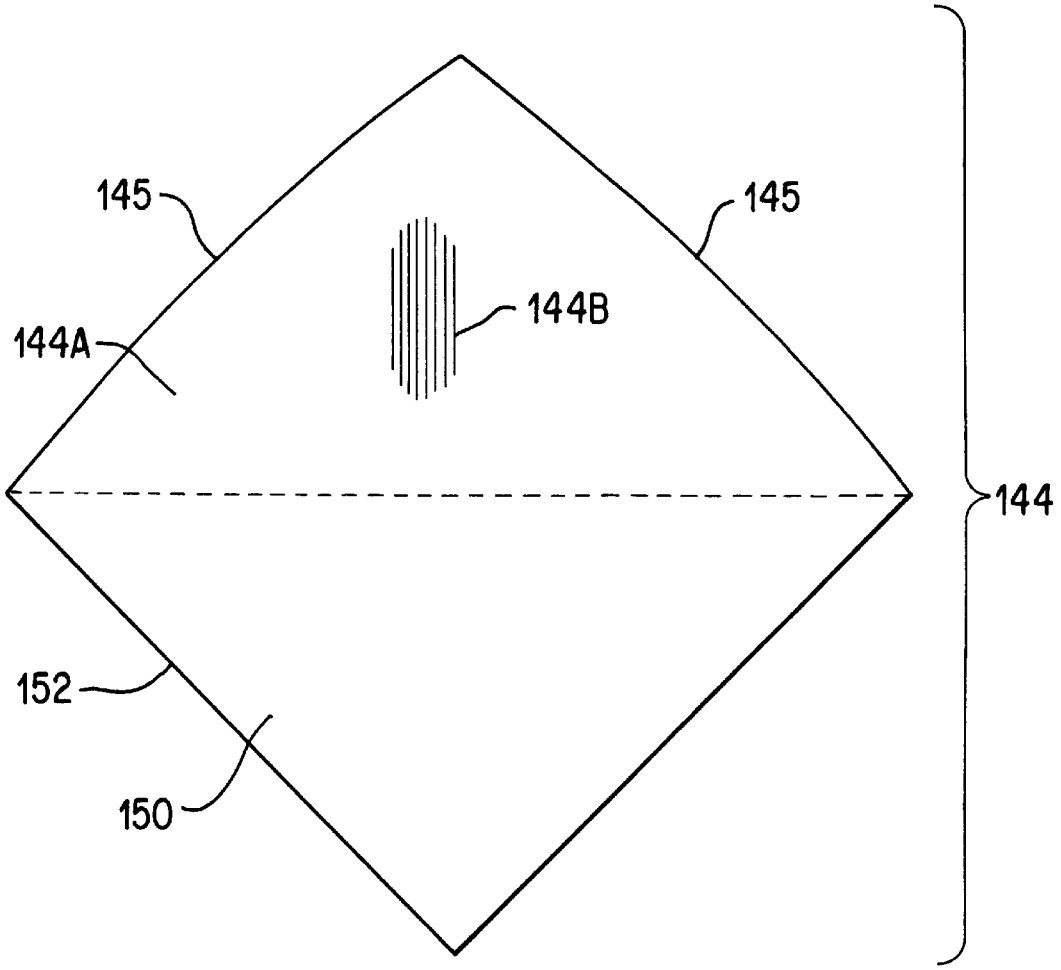
FIG. 14 is a plan view of a cut blank of corrugated fiberboard used to form the end of a curved lid arrangement in accordance with the present invention.
Figure 15:
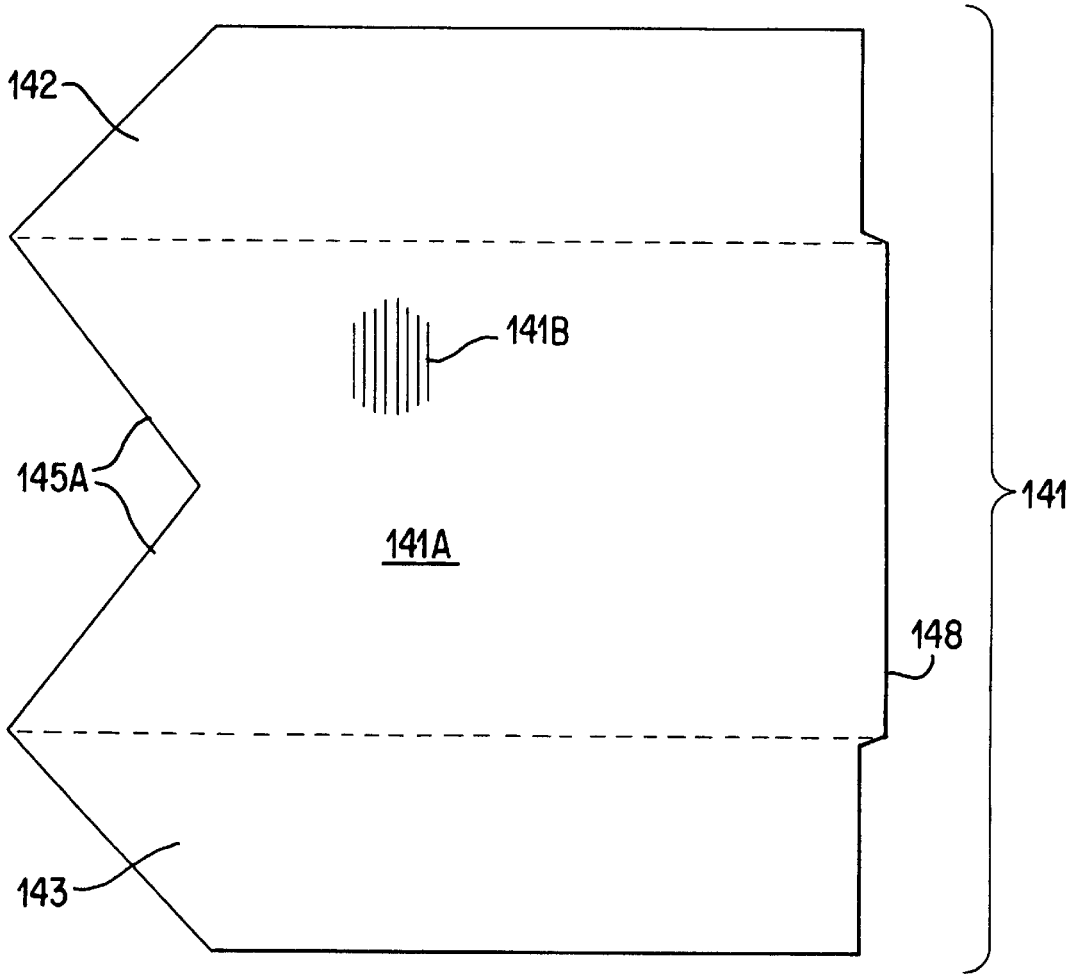
FIG. 15 is a plan view of a cut blank of corrugated fiberboard used to form the outer cover of the optional, curved, split-lid arrangement of the present invention.

The end of curve 144 is a die-cut sheet of preprinted, single-wall corrugated fiberboard, as detailed in FIG. 14. The lines 144B in FIG. 14 indicate the direction of corrugation of the end of curve 144. The panel 144A of the end of curve 144 is placed in an assembly jig to form the desired shape. A glue bead is placed along the edges 145 of the end of curve 144 illustrated in FIG. 14, and along the edges 145A of the shell 141 illustrated in FIG. 15, to form the total preprinted exterior of the curved lid 140 illustrated in FIG. 13A.

Figure 17:
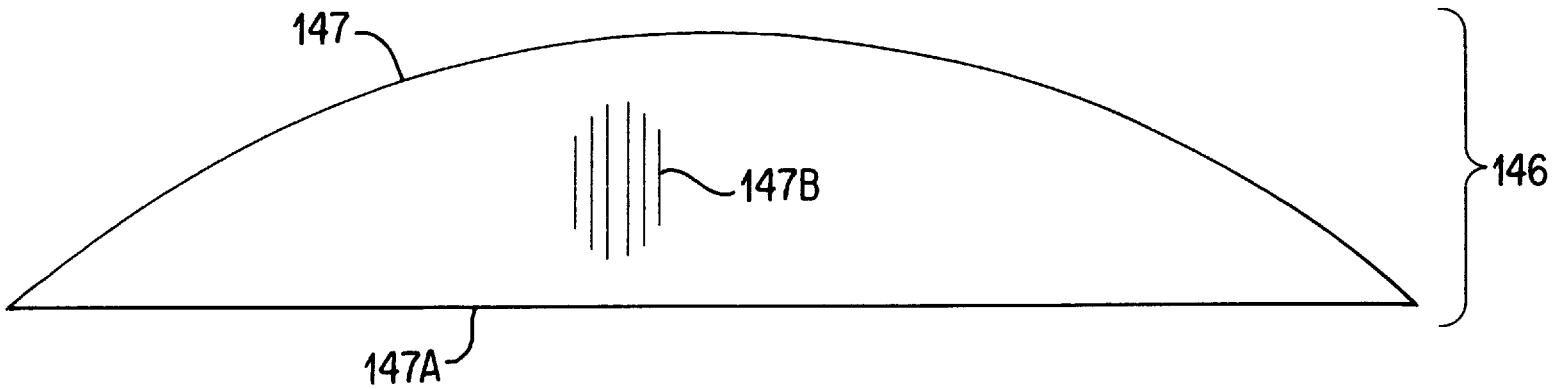
FIG. 17 is a plan view of a cut blank of corrugated fiberboard used to form the curved support used in the optional, curved split-lid arrangement of the present invention.

The curve support 146, detailed in FIG. 17, is a die-cut sheet of double-wall, corrugated fiberboard. Lines 147B indicate the direction of corrugation of the curve support 146. The edges 147 of the four curve supports 146 are glued into place so as to be equidistantly apart starting at the point of the edges 145 of the end of curve 144 and ending at the edge 148 of the shell 141, as illustrated in FIG. 13A.

Figure 16:
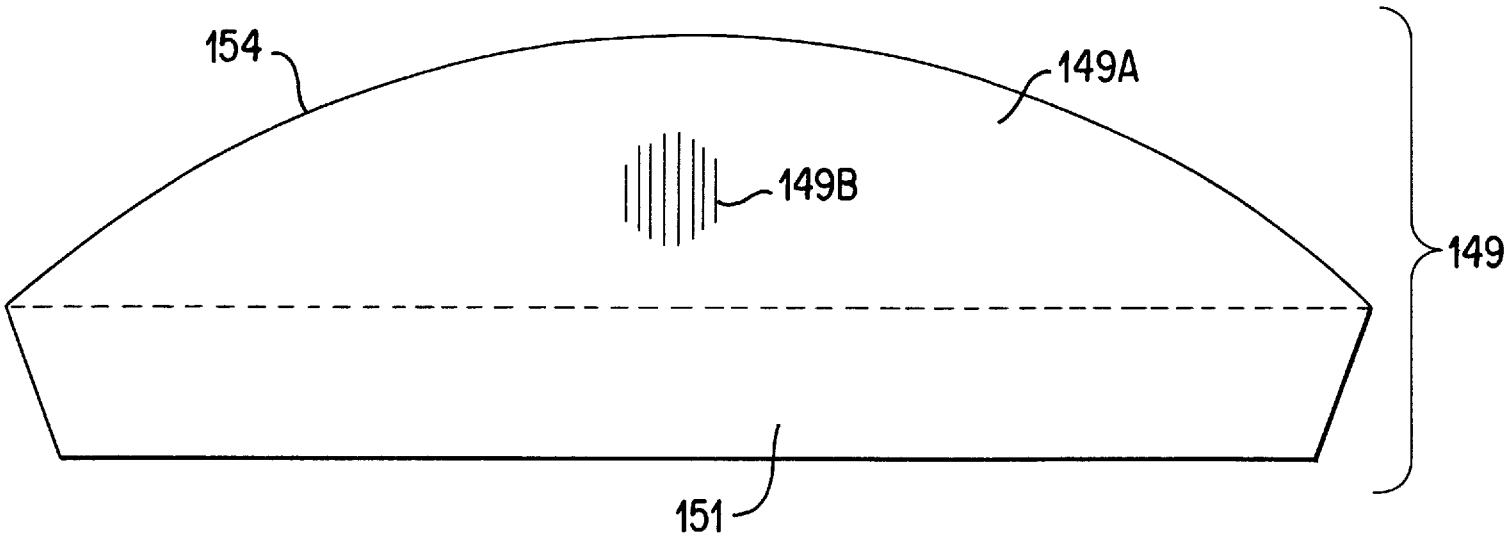
FIG. 16 is a plan view of a cut blank of corrugated fiberboard used to form the curved end cap of the optional, curved, split-lid arrangement of the present invention.

The curve end cap 149 is a die-cut sheet of preprinted, single-wall, corrugated fiberboard, as detailed in FIG. 16. The lines 149B indicate the direction of corrugation of the end cap 149. The kraft side of the panel 149A is glued to the exposed face of the curve support 146 on the end of the curve shell 141,as illustrated in FIG. 13A.

Figure 13B:
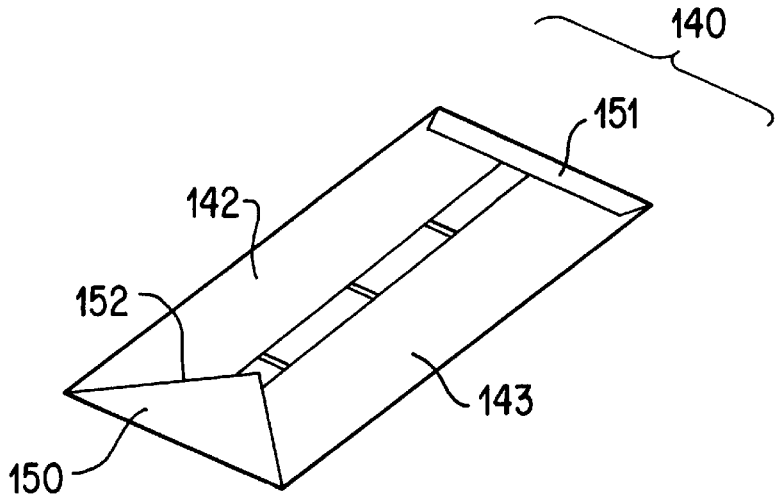
FIG. 13B is a perspective view of the bottom of the assembled, curved split-lid arrangement of the present invention.

Panels 142 and 143 of shell 141 are folded and glued to the edges 147A of the curve supports 146, as illustrated in FIGS. 13A and 13B. The panel 151 of end cap 149 is folded and glued to the panels 142 and 143 of the curve shell 141, as illustrated in FIGS. 13A and 13B. The panel 150 of the end of curve 144 is folded and glued to the exposed edge 147A of the curve support 146 and to the panels 142 and 143 of the curve shell 141, as illustrated in FIG. 13A and 13B.

The completed curved, split lid 140 is removed from the assembly jig, and can be added to the raised flat lid 130 by gluing the panels 142, 143, 150 and 151 to the preprinted side of the panel 102 of the lid or liner 101 of the flat lid 130, as illustrated in FIGS. 1, 3, 10, If and 22.

Figure 20:
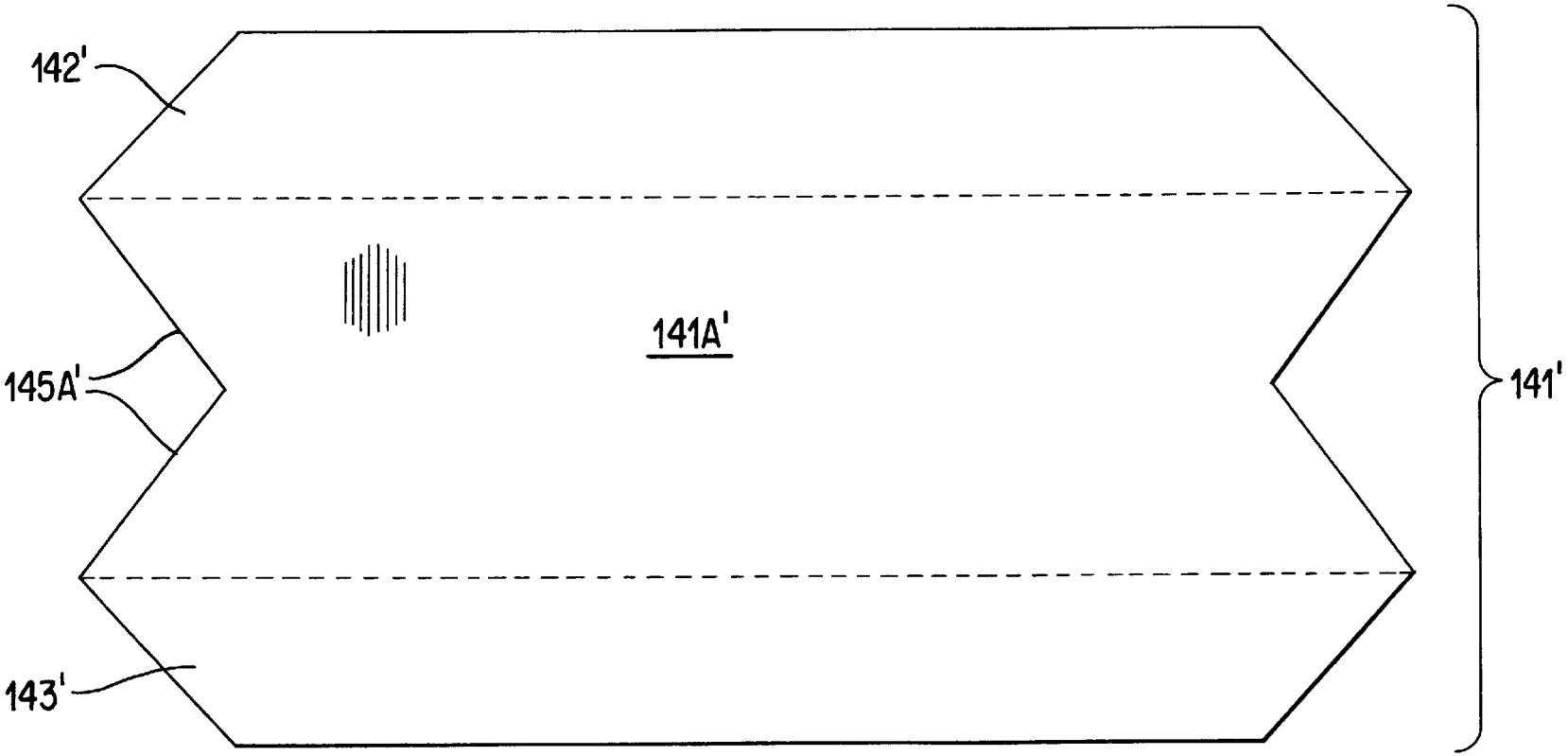
FIG. 20 is a plan view of a cut blank of corrugated fiberboard used to form the outer cover of the optional, curved full-lid arrangement of the present invention.

The assembly of the curved, full lid illustrated in FIGS. 2 and 4 is the same as the above-described assembly of the curved, split lid 140 of the FIGS. 13A and 13B, with the exception that the full-lid, curve shell 141' of FIG. 20 replaces the split-lid, curve shell 141 of FIG. 15. In actuality, the only difference between the shell 141 of FIG. 15 and the shell 141' of FIG. 20 resides in the fact that the full-lid, curve shell 141' of FIG. 20 is larger than the split-lid, curve shell 141 of FIG. 15, and the longitudinal dimensions of the corrugated pieces and the foam pieces are proportionally adjusted. In addition, the full-lid, curve shell 141' of FIG. 20 uses a different assembly jig. Nevertheless, both ends of the full-lid, curve shell 141' of FIG. 20 are assembled in the same manner, using the assembly method described above relative to the end of curve 144 illustrated in FIG. 14.

FIG. 21A is a plan view of the cut blanks of corrugated fiberboard relating to the optional corner moldings employed in the present invention. Specifically, the optional corner moldings 155 are scored sheets of preprinted, single-wall, corrugated fiberboard. The panels 156 and 157 of optional molding 155 are folded inward, leaving the preprinted liner exposed so that the panel 158 is perpendicular to the panel 157, and the outer edge of the panel 156 is glued to the kraft side of the panel 157. Panels 159 and 161 of the molding 155 are folded inward, leaving the preprinted liner exposed so that the panel 161 is perpendicular to the panel 160, and the outer edge of the panel 159 is glued to the kraft side of the panel 160. Panels 157 and 160 are folded inwardly at 90° angles, leaving the preprinted liner exposed.

Figure 7:
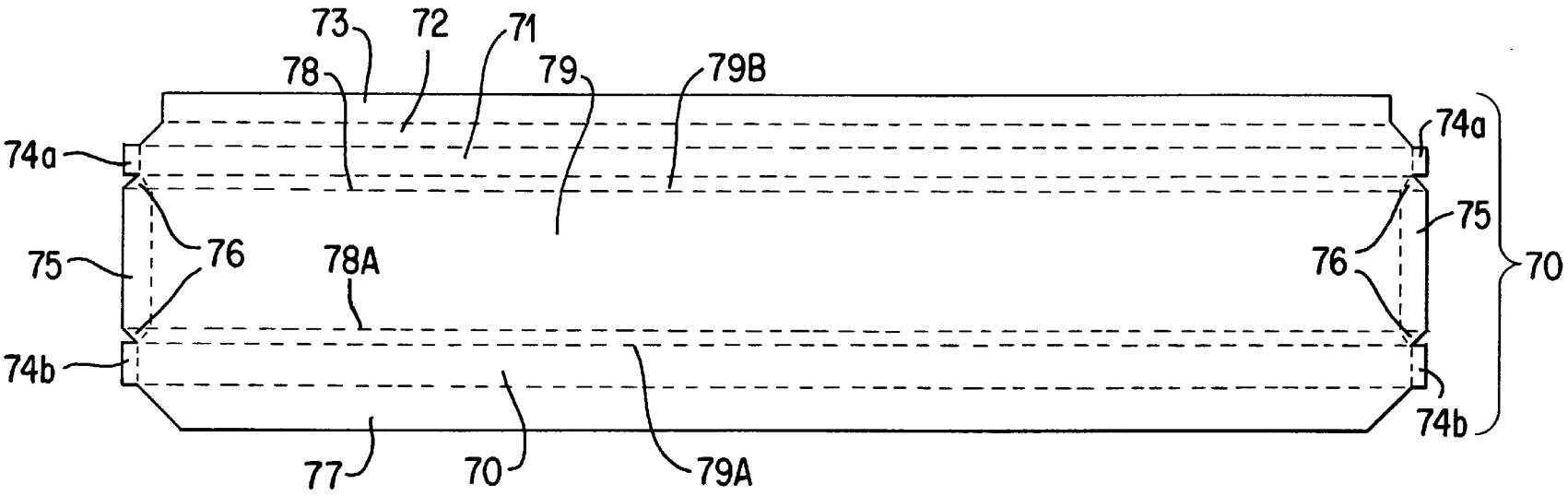
FIG. 7 is a plan view of the side wraps of the casket of the present invention.

Optional molding 155 can be adhered to the corners of the casket body by placing a glue bead on the panel 156 along the corner formed with the panel 158, and a glue bead on the panel 159 along the corner formed with the panel 161, and by placing the folded molding so that the glue bead on the panel 156 is in contact with the panel 82 of the end wrap 80 (FIG. 8), and so that the glue bead on the panel 159 is in contact with the panel 79 of the side wrap 70 (FIG. 7).

While preferred forms and arrangements have been shown in illustrating the invention, it is to be understood that various changes and modifications may be made without departing from the spirit and scope of this disclosure.

I claim:

1. A method of constructing a raised lid for a casket, comprising the steps of:

(a) providing a cut blank of corrugated fiberboard, including a center panel and four side panels, each side panel being separated from said center panel by a respective score line;

(b) dimensioning each of said side panels so that end portions of said each of said side panels are separated from respective end portions of adjacent side panels, thereby forming respective gaps; and (c) drawing said respective gaps together so as to form respective joints between said adjacent side panels and so as to form, at each said respective score line, an angle between each of said side panels and said central panel, thereby providing a desired rise in the lid.

2. The method of claim 1, further comprising step (d) of gluing the side panels together at said respective joints to form mitered corners.

3. The method of claim 1, further comprising step (d) of fixing corner reinforcers to adjacent side panels at each said respective joint, thereby providing strength and stability to said raised lid.

4. The method of claim 1, wherein step (a) includes providing said cut blank of corrugated fiberboard with four additional side panels, each of said additional side panels being connected to a respective one of said four side panels at respective additional score lines, each of said additional side panels being separated from adjacent additional side panels by a gap;

said method further comprising step (d) of fixing reinforcers across said gaps between said adjacent additional side panels.

5. The method of claim 4, further comprising step (e) of providing foam struts having first, second and third faces which are mutually angularly oriented, and step (f) of fixing said first face to said central panel, said second face to a respective one of said side panels, and said third face to a respective one of said additional side panels.

6. The method of claim 1, further comprising step (d) of providing foam struts having first and second faces which are mutually angularly oriented, and step (e) of fixing said first face to said central panel and said second face to a respective one of said side panels.

7. The method of claim 6, wherein step (a) comprises providing said cut blank of corrugated fiberboard with flange portions separated from said side panels by respective additional score lines, said method comprising the additional step, prior to step (e), of folding each said flange portion so that it contacts a kraft side of its adjacent side panel, and fixing said folded flange portion to said kraft side of its adjacent side panel, and wherein step (e) comprises fixing said second face to said side panel via said folded flange.

8. A method of constructing a curved lid for a casket, comprising the steps of:

(a) providing a first die-cut sheet having a central panel and opposing outer panels;

(b) forming said central panel of said first die-cut sheet into an arc-shaped curve shell;

(c) providing a plurality of second die-cut sheets which are substantially semi-circular in shape and have a straight edge and a curved edge;

(d) fixed said curved edges of said plurality of second die-cut sheets to an interior surface of said arc-shaped curve shell;

(e) folding said opposing outer panels inwardly over said plurality of second die-cut sheets so as to fix interior surfaces of said opposing outer panels to said straight edges of said second die-cut sheets.

9. The method of claim 8, wherein said central panel has a first edge extending between said opposing outer panels and a second edge opposing said first edge and extending between said opposing outer panels, said first edge being straight and said second edge forming an indentation;

said method further comprising the steps of providing a third die-cut sheet comprising an end of curve having an edge shaped in conformity to said second edge of said central panel, and fixing said edge of said end of curve to said second edge of said central panel.

10. The method of claim 9, wherein said end of curve has a first panel nearest said second edge and a second panel remote from said second edge and separated from said first panel by a score line;

said method further comprising the step of folding said first panel inwardly over said opposing outer panels.

11. The method of claim 9, further comprising the steps of providing a fourth die-cut sheet comprising a curve end cap having a panel, and fixing said panel of said curve end cap to one of said second die-cut sheets.

* * * * *